US005560125A

United States Patent [19]

Burgi

[11] Patent Number: 5,560,125

[45] Date of Patent: Oct. 1, 1996

[54] AIR IMPINGEMENT GEL DRYING

[75] Inventor: Dean S. Burgi, Menlo Park, Calif.

[73] Assignee: Genomyx Corporation, Foster City, Calif.

[21] Appl. No.: 353,119

[22] Filed: Dec. 9, 1994

Related U.S. Application Data

[63] Continuation-in-part of Ser. No. 304,942, Sep. 13, 1994, abandoned.

[51] Int. Cl.[6] ..... F26B 3/00

[52] U.S. Cl. ..... 34/508; 34/464; 34/611

[58] Field of Search ..... 34/201, 231, 232, 34/251, 252, 155, 156, 218, 225, 444, 464, 508, 611, 614, 632, 643, 107; 126/21 A, 21 R; 204/299 R; 264/40.3, 40.6

[56] References Cited

U.S. PATENT DOCUMENTS

| | | | |
|---|---|---|---|
| 1,051,640 | 1/1913 | Sargent | 34/611 |
| 3,905,760 | 9/1975 | Johansson et al. | 432/176 |
| 3,935,646 | 2/1976 | Grandine et al. . | |
| 4,020,563 | 5/1977 | Hoefer | 34/48 |
| 4,197,657 | 4/1980 | Leino et al. . | |
| 4,523,391 | 6/1985 | Smith et al. . | |
| 4,612,710 | 9/1986 | Fernwood et al. | 34/16 |
| 4,715,129 | 12/1987 | Uchida . | |
| 4,750,276 | 6/1988 | Smith et al. . | |
| 4,757,800 | 7/1988 | Shei et al. . | |
| 4,883,597 | 11/1989 | Perlman | 204/182.8 |
| 5,060,572 | 10/1991 | Waizmann | 34/444 |
| 5,167,078 | 12/1992 | Bolde et al. | 34/444 |

FOREIGN PATENT DOCUMENTS

| | | | |
|---|---|---|---|
| 01266 | 4/1984 | European Pat. Off. . | |
| 01424 | 4/1984 | European Pat. Off. . | |
| 941358 | 4/1956 | Germany | 34/611 |
| 9401195 | 3/1994 | Germany . | |
| 84/01266 | 4/1984 | WIPO . | |

*Primary Examiner*—John T. Kwon
*Attorney, Agent, or Firm*—Banner & Allegretti, LTD.

[57] ABSTRACT

A method for drying electrophoresis gel comprising, in combination, using a gaseous moisture removing medium, a gaseous moisture removing medium driving means, and an impingement means, whereby the gaseous moisture removing medium is driven by the gaseous moisture removing medium driving means across the impingement means to provide a flow of the gaseous moisture removing medium on the surface of the gel plates, whereby the flow induced by passage of the gaseous moisture removing medium through the impingement means thereby minimizes temperature gradients within the gel by forced convection and reduces drying time of the gel.

8 Claims, 9 Drawing Sheets

AIR IMPINGEMENT GEL DRYING

This is a continuation in part application of U.S. application Ser. No. 08/304,942, filed Sep. 13, 1994, now abandoned.

BACKGROUND OF THE INVENTION

1. Field of the Invention

This invention relates to a drying apparatus and method for DNA sequencing. More specifically, the present invention is directed to a drying apparatus and method for drying a gel that has undergone gel electrophoresis and before the DNA bands are visualized by autoradiography. Gel drying is a necessary step in for accurate DNA sequencing. The presence of water will adversely effect accurate determination of the DNA bands by autoradiography for two primary reasons. First, the film used in autoradiography will tend to stick to water in the gel, thereby preventing the exposed film from being separated from the gel, which in turn prevents the exposed film from being able to be developed. In addition, water can be a β particle blocker, and thus, the presence of water in the gel will result in adverse readings.

The present invention includes the use of an apparatus comprising a turbulent-flow, gas moisture removing medium impingement-based subassembly, i.e. air impingement gel dryer. In the present invention, gel drying is accomplished by taking a gel that is adhered to glass plate directly from the electrophoresis device after electrophoresis and placing the gel and glass plate into the air impingement gel dryer.

Particular features of the present invention include the elimination of transferring the gel from a glass plate to paper for drying by a conventional vacuum gel dryer, decreasing the amount of time required using conventional oven drying of electrophoresis gel on a glass plate, and decreasing the amount of heat needed for sufficient gel drying.

These advantageous features of the present invention result in improved speed, reliability and readability of DNA sequence analysis. More specifically, the present invention results in reducing the time of gel drying by about one-third, and an improvement or at least 10% in the amount of DNA sequence that can be determined.

2. Description of the Prior Art

Gel electrophoresis is a fundamental biochemical separation technique that forms the basis for distinguishing a variety of biologically important molecules on the basis of size, charge or a combination thereof. Specific examples of biological molecules advantageously separated by gel electrophoresis include proteins and nucleic aids. Electrophoresis is usually performed in a gelled (e.g., agarose) or polymerized (e.g., polyacrylamide) media (generically termed a "gel") that contains an electrically conducting buffer. Electrophoresis is performed wherein a voltage is applied via chemically inert metal electrodes across the cross-sectional area of the gel. The biological sample of interest is placed into pre-formed sample wells in the gel, usually at one end of the gel, and the polarity of the applied voltage is arranged so that the biological sample migrates through the gel towards one of the electrodes (usually positioned at the opposite end of the gel from the samples). Where appropriate, the inverse linear relationship between migration distance and molecular size is maintained by the addition of chemical denaturants (such as urea, formamide, or sodium dodecyl sulfate) to the gel and electrophoresis buffer.

A particular application of gel electrophoresis is the separation of single-stranded DNA fragments in the determination of the nucleotide sequence of a nucleic acid of interest. To this end, a collection of single-stranded DNA fragments is generated either by chemical degradation of the nucleic acid (using the Gilbert method, see e.g., Maxam and Gilbert (1980), Methods Enzyme, 65, p499–500) or by replacement DNA synthesis using a polymerase (using the Sanger method, see e.g., Sanger, F., Niklen, S., and Coulson, A. R. (1977) Proc. Nat. Acad. Sci. USA 74, p5463–5467). This collection of single stranded DNA fragments includes a fragment corresponding to each position in the sequence to be determined; in the most frequently-used sequencing method, this correspondence is directly related to the distance from a fixed site of initiation of polymerization at a primer that is annealed to the nucleic acid to be sequenced. Thus, determination of the desired sequence depends on the separation of each of the fragments, which differ in length by only a single nucleotide.

Traditionally, the identity of each of the possible nucleotides at each position (adenine, guanine, cytosine or thymidine) is distinguished by performing a sequencing reaction specific for each ending nucleotide in separate chemical reaction mixtures. Thus, each sequencing experiment is typically performed in 4 separate tubes, wherein are generated a collection of fragments each ending at a position corresponding to the terminating nucleotide used in that reaction. A nucleotide sequence is thereafter determined by performing denaturing gel electrophoresis on each of a set of 4 reactions, each reaction electrophoresed individually in adjacent lanes of a single sequencing gel. The presence of a band at a position in a nucleotide-specific lane of such a gel indicates the identity of that nucleotide at that position in the sequence. Using conventional techniques, each of the fragments is radiolabeled, and the bands are visualized after electrophoresis by autoradiography.

A number of constraints limit the extent of nucleotide sequence information that can be obtained when conventional gel drying of electrophoresis gels is used. The primary constraint is the amount of diffusion of DNA sequence bands. More specifically, this diffusion, also called band broadening, on the autoradiographic film results in diminished DNA sequence readings and determination. Moreover, the transfer of the gel from the glass plate to the paper can physically distort the gel sufficiently enough to cause band broadening.

Diffusion of DNA sequence bands that results from the use of conventional gel drying consists of a number of diffusion factors, which include, temperature and time factors. The greater the temperature and time needed to dry the gel, the greater the Brownian motion of the DNA molecules and the greater the diffusion of DNA sequence bands. When the gel is transferred from a glass plate to paper for drying by a conventional vacuum gel dryer, other diffusion factors arise, including diffusion due to the fact that paper has far greater porosity than glass.

The total variance of a peak in field-amplified capillary electrophoresis has been defined by the following equation:

$$\sigma^2=\sigma_{diff}^2+\sigma_{inj}^2+\sigma_{ther}^2+\sigma_a^2$$

where $\sigma_{diff}^2$ is the variance due to diffusion (which in turn varies with temperature and time), $\sigma_{inj}^2$ is the variance due to injection, $\sigma_{ther}^2$ is the variance due to the thermal effects in the separation process, and $\sigma_a^2$ is the variance of the peak due to all other factors.

Current gel drying methods involve conventional oven drying. This method necessarily involves removing the gel from the electrophoresis apparatus and placing the gel into an oven.

When gel electrophoresis is conducted in a gel electrophoresis apparatus having an air impingement subassembly, gel drying can be accomplished using the same apparatus if desired with minor modifications, such as removing one of the glass plates from the gel and removing the electrophoresis buffer.

To summarize, the present invention results in improved resolution in less time.

SUMMARY OF THE INVENTION

This invention relates to the use of air impingement drying of electrophoresis gel. In particular, this invention relates to forced air methods and apparatus for reducing drying times with lower temperatures and heat, and improving DNA band resolution determination of longer DNA sequences.

In particular, this invention discloses the use of several split flow methods that provide symmetrical heat transfer to the gel that is adhered to a glass plate and a corresponding improvement in the resolution of separated DNA fragments.

The invention is useful in determining DNA sequences by slab gel electrophoresis and in particular the reading of DNA sequences to much longer lengths than is the present practice, and reducing gel drying times.

Other advantages of the present invention include high heat transfer coefficients.

The present invention has the further ability of eliminating the step of gel removal from the electrophoresis apparatus because the drying of the gel can be accomplished using air impingement gel drying, rather than conventional oven drying that necessarily involves gel removal from the electrophoresis apparatus and placement into an oven.

BRIEF DESCRIPTION OF THE PREFERRED EMBODIMENTS

DETAILED DESCRIPTION OF THE PREFERRED EMBODIMENTS

Figure 1:
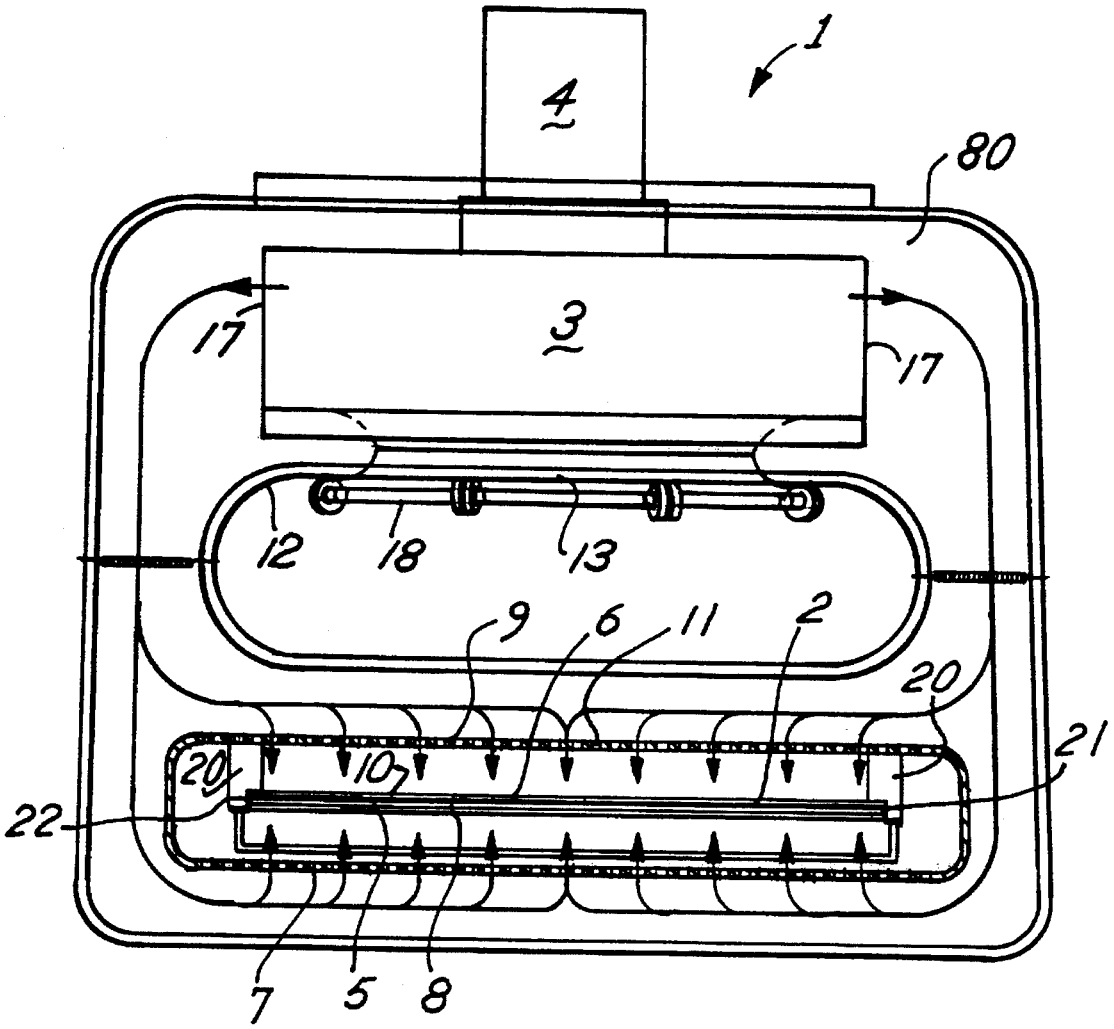
FIGS. 1 and 2 are top and side views of a preferred embodiment of an apparatus for use in the present invention having a double sided tangential air impingement gel drying apparatus having a single fan at one side of the apparatus.
Figure 2:
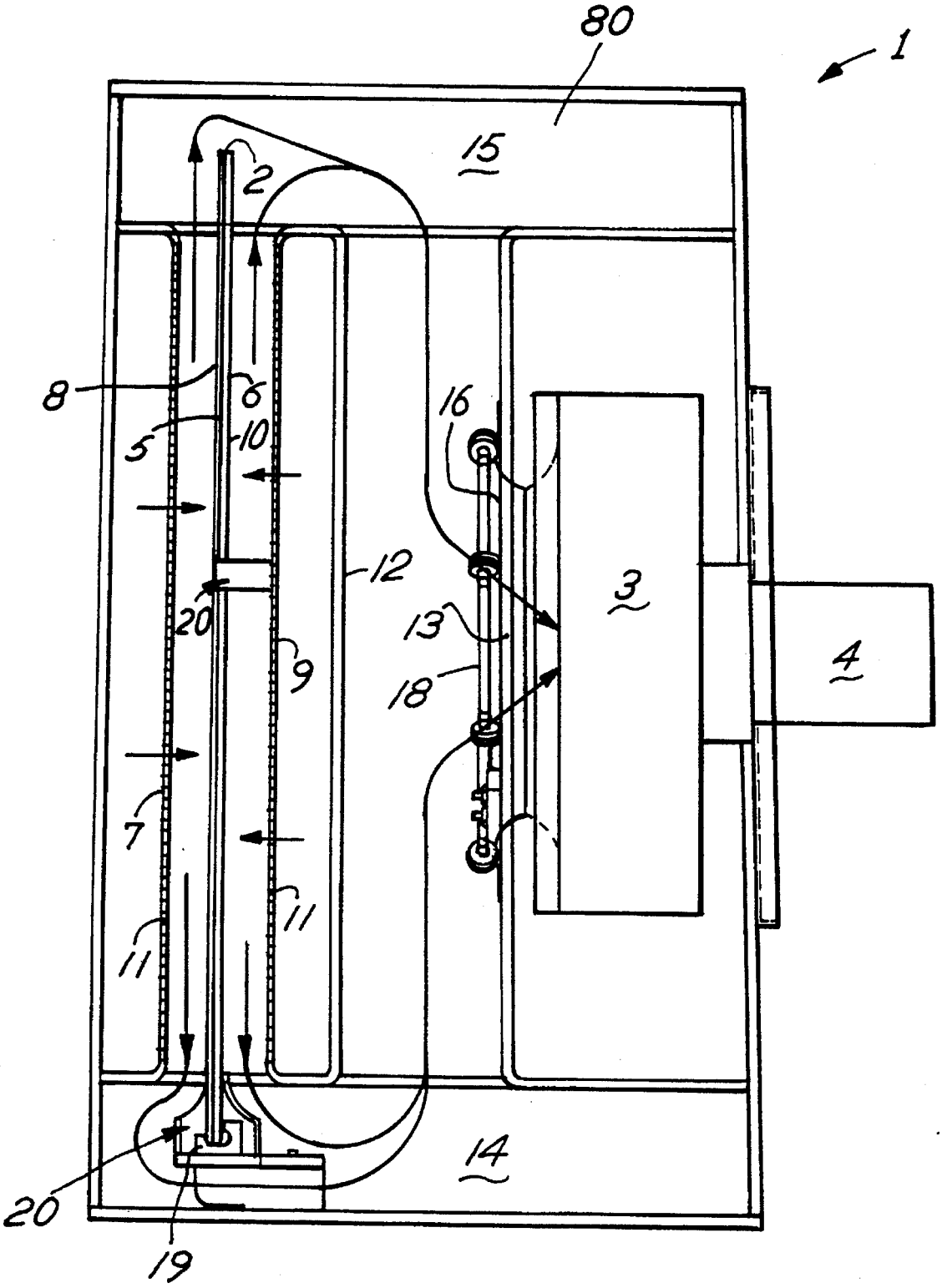

FIG. 1 and 2 embodiments of the apparatus for use in the present invention having forced-air methods for gel drying after the gel has undergone electrophoresis. Air flow is shown with arrows. More specifically, FIG. 1 and 2 show a preferred embodiment of the apparatus for use in the present invention having an air impingement gel temperature control apparatus 1. Air flow is shown with arrows. Apparatus 1 has an enclosed chamber 80 and an electrophoresis gel/glass plate combination 2, and a blower fan 3 powered by a single motor 4. The electrophoresis gel/glass plate combination 2 is comprised of gel 5 (the thickness of which has been enlarged in the figures so that it can be identified) that is adhered to a glass plate 6. In addition, apparatus I also has a front impingement plate 7 that faces front 8 of gel 5, and a back impingement plate 9 that faces back 10 of glass plate 6. Front impingement plate 7 and back impingement plate 9 have a plurality of impingement holes 11.

Apparatus 1 also has a diverter plate 12 that is positioned between blower fan 3 and back impingement plate 9. Alternatively, gel 5 can be positioned between glass plate 6 and diverter plate 12. Air is circulated by blower fan 3 around diverter plate 12 in a split flow manner and around impingement plates 7 and 9. The circulating air enters through impingement holes 11 :and carries away moisture away from gel 5. High gel drying is obtained by the air flowing at high velocity through the holes 11 in the impingement plates 7 and 9 at substantially right angles to the gel 5 and glass plate 6. The air then flows along the gel 5 and glass plate 6, and then returns to the intake 13 of the blower fan 3. Thus, the circulating air enters through impingement holes 11 and then carries moisture away from gel 5.

As shown in FIG. 2, the air can return to the blower fan 3 from the bottom portion 14 and/or the top portion 15 of apparatus 1. Apparatus I has a barrier 16 that separates the air exiting from exit 17 of blower fan 3 and the air returning to the blower fan 3 at intake 13. In addition, apparatus I has a heated coil 18 that is positioned in front of intake 13. Heated coil 18 acts to heat air before it enters blower fan 3. The heated air acts to heat both the gel 5 and the glass plate 6, and thereby vaporize moisture in gel 5. While in blower fan 3, the heated air is mixed so that the air exiting blower fan 3 at exit 17 is substantially the same temperature.

In addition, the gel/glass plate combination 2 sits on top of support 19 and is held in a substantially vertical position by clips 20 along edges 21 and 22 of gel/glass plate combination 2. Support 19 can be the bottom of a lower buffer reservoir 23 of an electrophoresis apparatus that does not contain a lower buffer solution.

Figure 3:
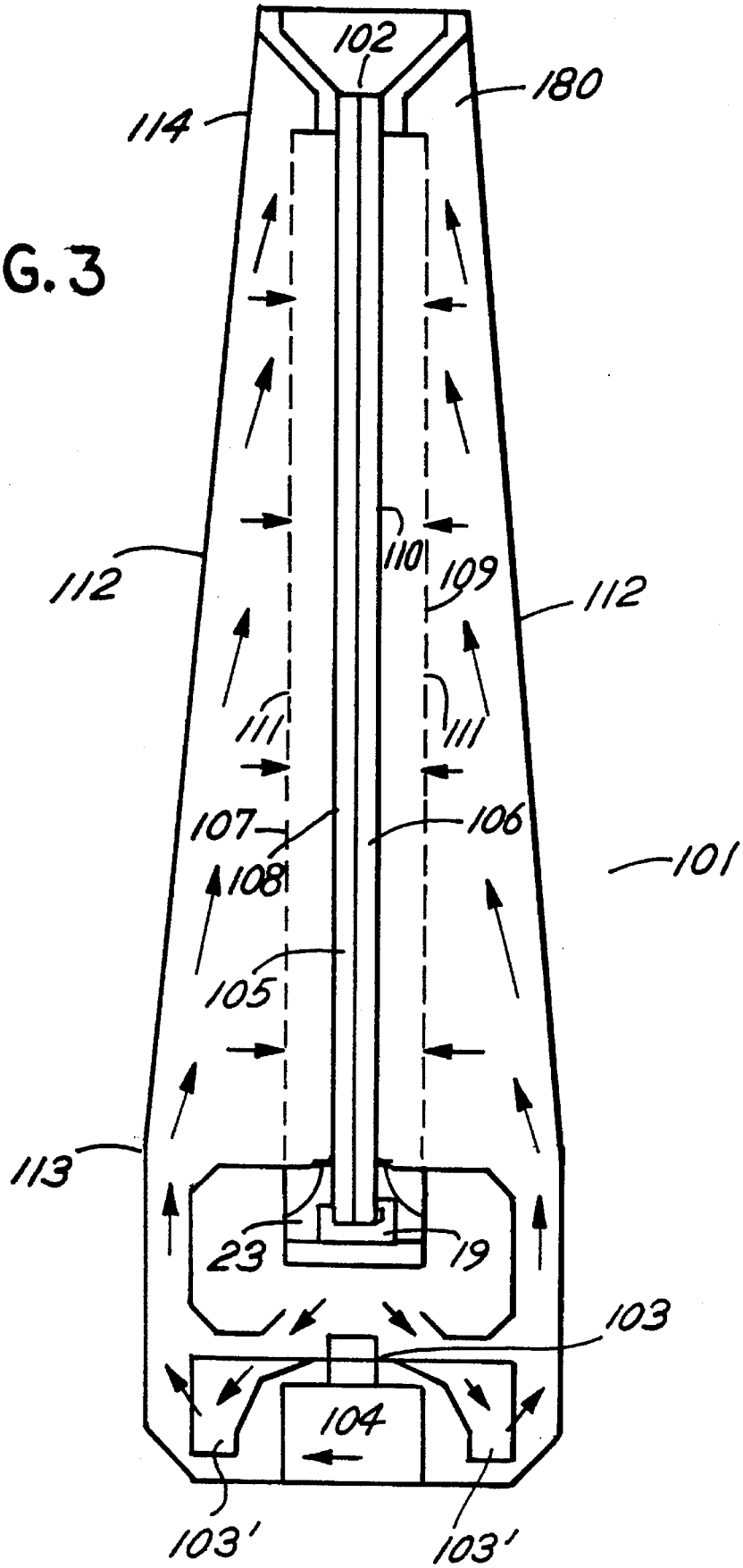
FIG. 3 is a side view of an alternative preferred embodiment of an apparatus for use in the present invention having air impingement plates in front of the front of the gel and behind the back of the glass plate, and having a fan below the gel and glass plate.

FIG. 3 show an alternative embodiment of the present invention. In FIG. 3, an impingement two sided apparatus 100 has an enclosed chamber 180, an electrophoresis gel/glass plate combination 102, and a fan 103 that is driven by motor 104. Electrophoresis gel/glass plate combination 102 is comprised of gel 105 (the thickness of which has been enlarged in FIG. 3 so that it can be identified) that is adhered to a glass plate 106. Fan 103 is positioned below electrophoresis gel/glass plate combination 102. Further, fan 103 has propeller blades 103'. Further, apparatus 101 also has a front impingement plate 107 that faces front 108 of gel 105, and a back impingement plate 109 that faces back 110 of glass plate 106. Both front impingement plate 107 and back impingement plate 109 have a plurality of impingement holes 111.

Fan 103 circulates air from beneath gel/glass plate combination 102 in a split flow manner and up along both front impingement plate 107 and back impingement plate 108. The circulating air enters through impingement holes 111 and then flows back down towards the fan 103. In this apparatus, the air flowing through impingement holes 111 impinge on the front 108 of gel 105 and back 110 of glass plate 106 at substantially right angles, thereby creating local turbulence and very high moisture removal from the gel 105. Apparatus 101 is substantially symmetrical in that the impingement holes 111 line up along both front 108 and back 110 and the air flow is balanced by having a symmetrical design and large air distribution chambers.

Apparatus 101 has walls 112 that taper as they extend from the bottom portion 113 of apparatus 101 to the top portion 114 of apparatus 101. In this embodiment, a heated coil can be positioned just above fan 103 in order to heat air before it is blown by fan 103 up to the gel/glass plate combination 102. As in the embodiment shown in FIG. 1 and 2, the gel/glass plate combination can sit on a support 19 and be held in a substantially vertical position by clips (that are not shown but are the same as clips 20 in FIG. 1 and 2). Again, the support 19 can be the bottom of a lower buffer reservoir 23 that does not contain a lower buffer solution.

Figure 4:
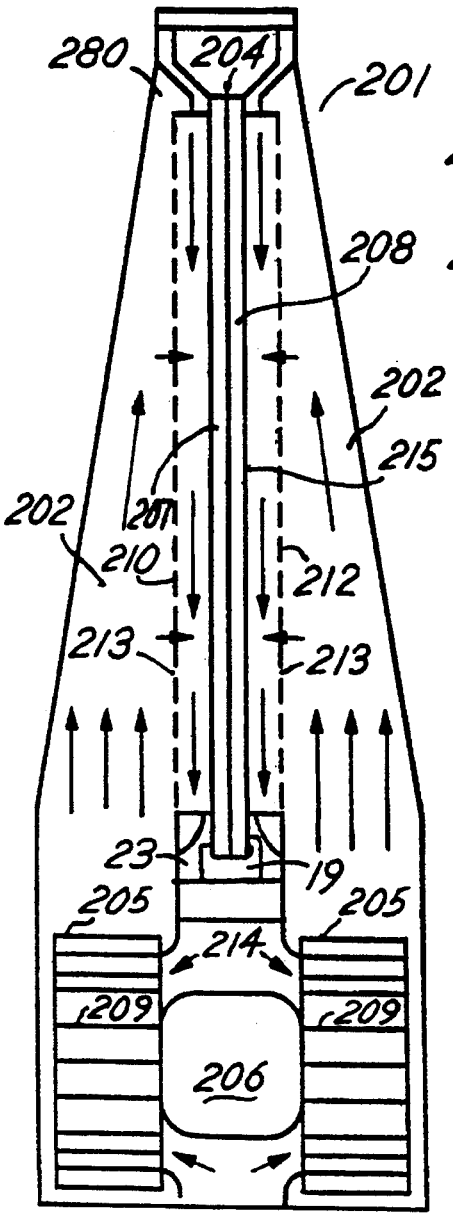
FIGS. 4 and 5 are side and front views of another alternative preferred embodiment of an apparatus for use in the present invention having a turbulent-flow, two sided jet impingement apparatus having two scroll fans powered by a single drive motor drive.
Figure 5:
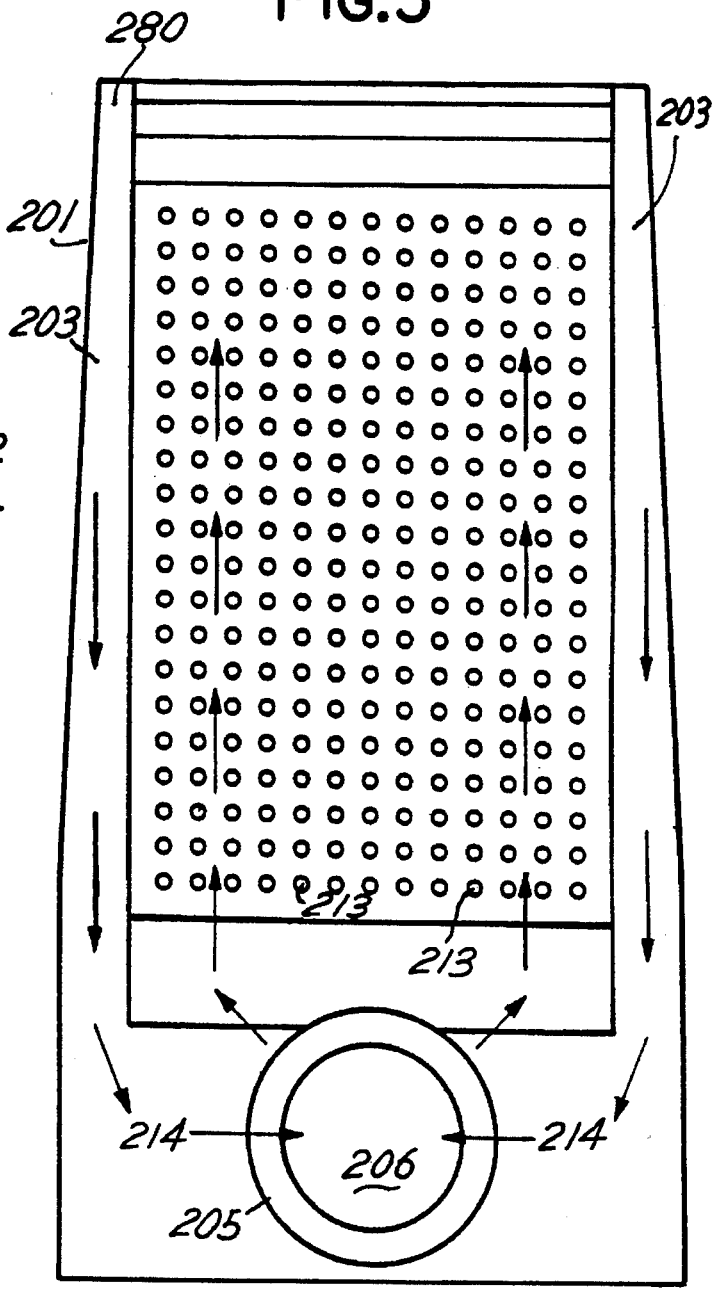

FIGS. 4 and 5 show another embodiment of the apparatus for use in the present invention having a turbulent-flow, two sided jet impingement apparatus 201 having an enclosed chamber 280. Enclosed chamber 280 has front and back chambers 202 and side chambers 203. Air flow is shown with arrows. Apparatus 201 also has an electrophoresis gel/glass plate combination 204, and two scroll fans 205 powered by a single motor drive 206. Electrophoresis gel/glass plate combination 20,; is comprised of a gel 207 (the thickness of which has been enlarged in FIG. 4 so that it can be identified) that is adhered to a glass plate 208. Fans 205 are positioned below electrophoresis gel/glass plate combination 204. Further, fans 205 have propeller blades 209. Further, apparatus 201 also has a front impingement plate 210 that faces front 211 of gel 207, and a back impingement plate 212 that faces back 215 of glass plate 208. Both front impingement plate 210 and back impingement plate 212 have a plurality of impingement holes 213.

Air is circulated by fans 205 from below gel/glass combination 204 and up along and through chambers 202. The circulating air enters through impingement holes 213 and then, as the air moves to side chambers 203, the air carries moisture away gel 207. The air then flows through side chambers 203 and to intake 214 of the scroll fans 205. High moisture removal from gel 207 is obtained by the air flowing at high velocity through the holes 213 in the impingement plates 210 and 212 at substantially right angles to the gel 207 and glass plate 208. In this embodiment, a heated coil can be positioned just above fans 205 in order to heat air before it is blown by fans 205 up to the gel/glass plate combination 204.

As in the embodiment shown in FIG. 1 and 2, the gel/glass plate combination can sit on a support 19 and be held in a substantially vertical position by clips (that are not shown but are the same as clips 20 shown in FIGS. 1 and 2). Again, the support 19 can be the bottom of a lower buffer reservoir 23 that does not contain a lower buffer solution.

Figure 6:
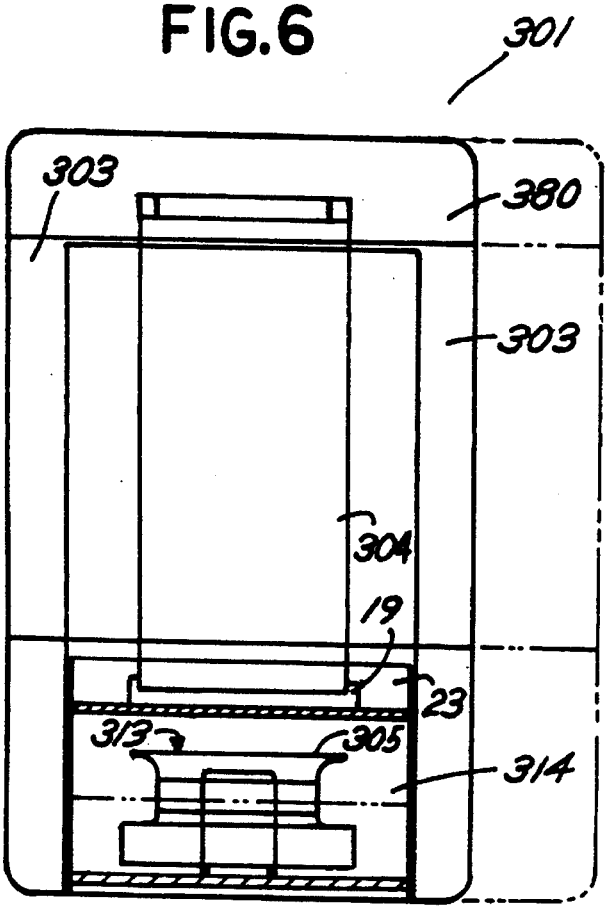
FIGS. 6 and 7 are front and side views of another preferred embodiment of an apparatus for use in the present invention having a double-sided tangential-blower jet impingement system having a single blower.
Figure 7:
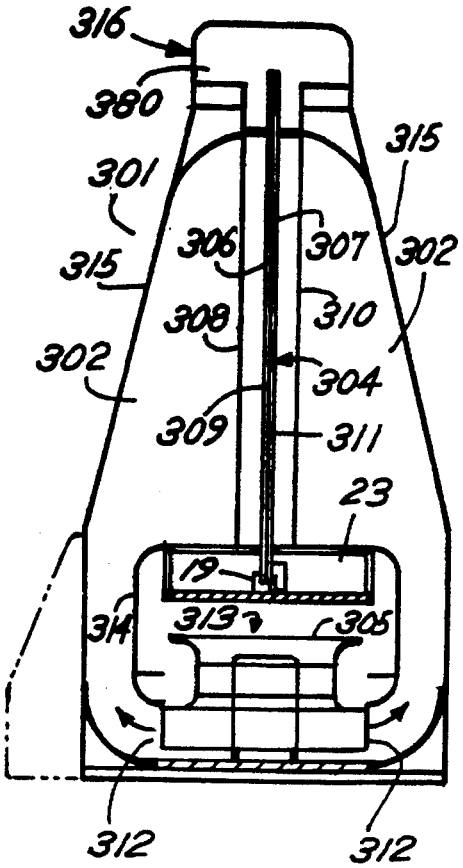

FIGS. 6 and 7 show another embodiment of the apparatus for use in the present invention having a double-sided tangential-blower jet impingement apparatus 301 having an enclosed chamber 380. Enclosed chamber 380 has front and back chambers 302 and side chambers 303. Air flow is shown with arrows. Apparatus 301 has an electrophoresis gel/glass plate combination 304, and a single blower fan 305 powered by a motor that is not shown. Electrophoresis gel/glass plate combination 304 is comprised of a gel 306 (the thickness of which has been enlarged in FIG. 7 so that it can be identified) that is adhered to a glass plate 307. Blower fan 305 is positioned below electrophoresis gel/glass plate combination 304. Further, apparatus 301 also has a front impingement plate 308 that faces front 309 of gel 306, and a back impingement plate 310 that faces back 311 of glass plate 307. Both front impingement plate 308 and back impingement plate 310 have a plurality of impingement holes (that are not shown but are the same as tile impingement holes 213 as shown in FIGS. 4 and 5).

Air is circulated by blower fan 305 at exit 312 from below electrophoresis gel/glass plate combination 304 and up along and through chambers 302. The circulating air enters through the impingement holes and then, as the air moves to side chambers 303, the air carries moisture away from gel 306. The air then flows through side chambers 303 and to the intake 313 of blower fan 305. High moisture removal from gel 306 is obtained by the air flowing at high velocity through the holes in the impingement plates 308 and 310 at substantially right angles to the gel 306 and glass plate 307. Apparatus 301 has a barrier 314 that separates the air exiting from exit 312 and the air returning at intake 313. Apparatus 301 also has tapered walls 315 having a hinged top lid 316 that can be lifted off to allow access to the inside of apparatus 301.

Apparatus 301 is similar to apparatus 201 shown in FIGS. 4 and 5 in that they both have a tangential double sided apparatus, however they are different in that instead of two scroll fans 205 as in apparatus 201, apparatus 301 has a single tangential blower fan 305. In this embodiment, a heated coil can be positioned just above fan 305 in order to heat air before it is blown by fan 305 up to the gel/glass plate combination 304.

As in the embodiment shown in FIG. 1 and 2, the gel/glass plate combination can sit on a support 19 and be held in a substantially vertical position by clips (that are not shown but are the same as clips 20 shown in FIG. 1 and 2). Again, the support 19 can be the bottom of a lower buffer reservoir 23 that does not contain a lower buffer solution.

Figure 8:
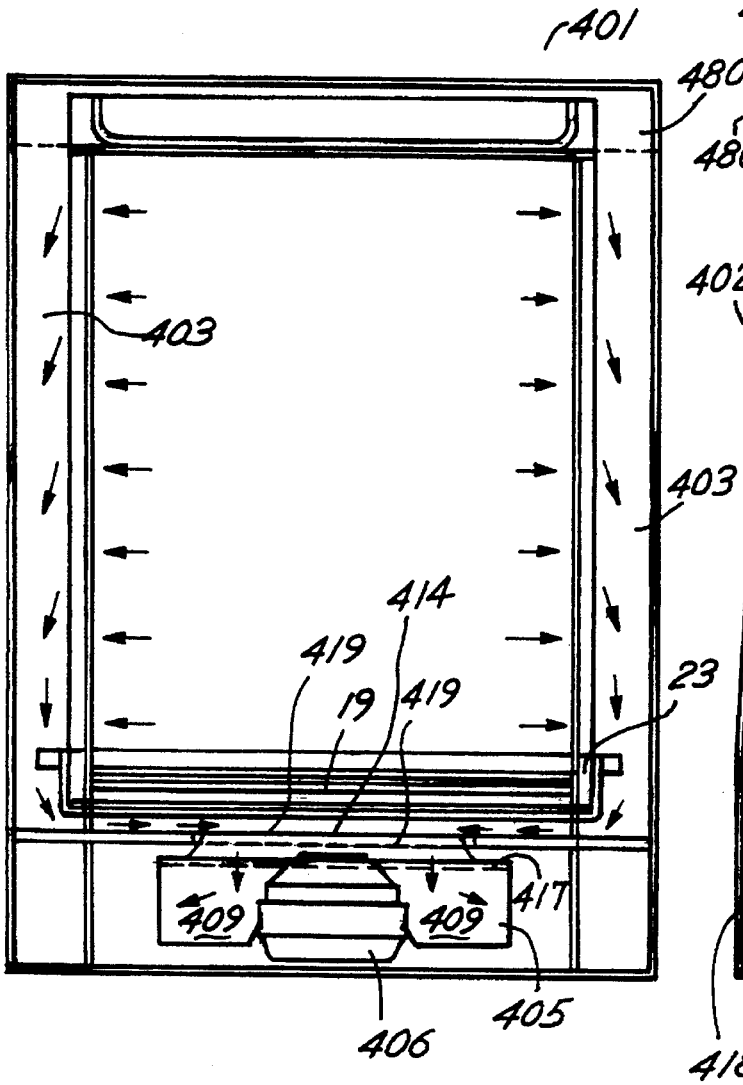
FIGS. 8 and 9 are front and side views of another preferred embodiment of an apparatus for use in the present invention having a double-sided tangential-fan system having a single fan at the bottom of the apparatus.
Figure 9:
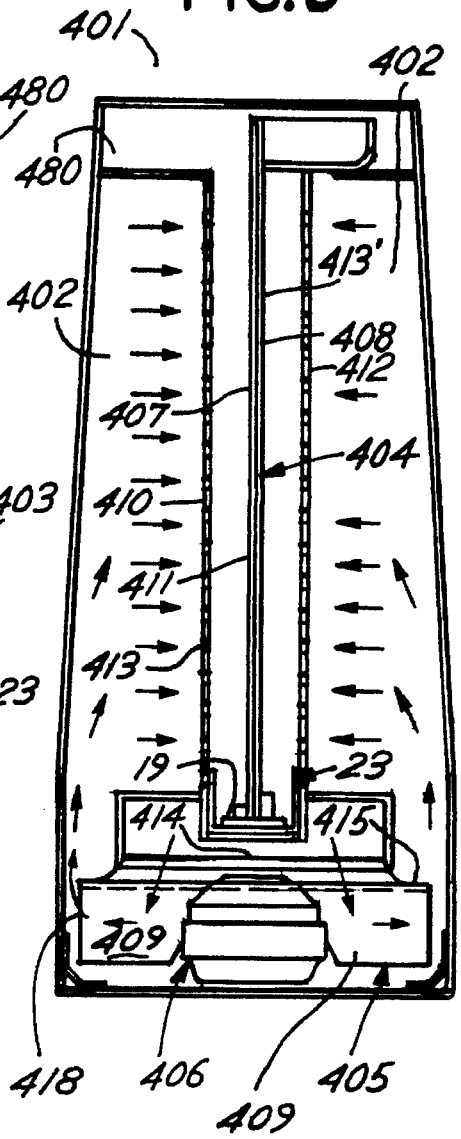

FIGS. 8 and 9 show another embodiment of the apparatus for use in the present invention having an air impingement gel drying apparatus 401 having an enclosed chamber 480. Enclosed chamber 480 has front and back chambers 402 and side chambers 403. Air flow is shown with arrows. Apparatus 401 has an electrophoresis gel/glass plate combination 404, and a blower fan 405 powered by a single fan motor 406. Electrophoresis gel/glass plate combination 404 is comprised of a gel 407 (the thickness of which has been enlarged in FIG. 9 so that it can be identified) that is adhered to a glass plate 408. Blower fan 405 is positioned below electrophoresis gel/glass plate combination 404. Further, blower Fan 405 has propeller blades 409. Further, apparatus 401 also has a front impingement plate 410 that faces front 411 of gel 407, and a back impingement plate 412 that Faces back 413 of glass plate 408. Both front impingement plate 410 and back impingement plate 412 have a plurality of impingement holes 413 (that are not shown in FIG. 8 but are the same as the impingement holes 213 in FIG. 5).

Air is circulated by blower fan 405 from below gel/glass plate combination 404 and up and through chambers 402.

The circulating air enters through impingement holes 413 and then, as the air moves to side chambers 403, the air carries moisture away from gel 407. The air then flows through side chambers 403 and to intake 414 of blower fan 405. High moisture removal From gel 407 is obtained by the air flowing at high velocity through the holes 413 in the impingement plates 410 and 412 at substantially right angles to the gel 407 and glass plate 408. Apparatus 401 has a barrier 415 that separates the air exiting from exit 418 of blower fan 405 and the air returning to the blower fan 405 at intake 414. Apparatus 401 also has mounting plates 419 for mounting the blower fan 405 and motor 406. In this embodiment, a heated coil can be positioned just above fan 405 in order to heat air before it is blown by fan 405 up to the gel/glass plate combination 404.

As in the embodiment shown in FIG. 1 and 2, the gel/glass plate combination can sit on a support 19 and be held in a substantially vertical position by clips (that are not shown but are the same as clips 20 shown in FIG. 1 and 2). Again, the support 19 can be the bottom of a lower buffer reservoir 23 that does not contain a lower buffer solution.

Figure 10:
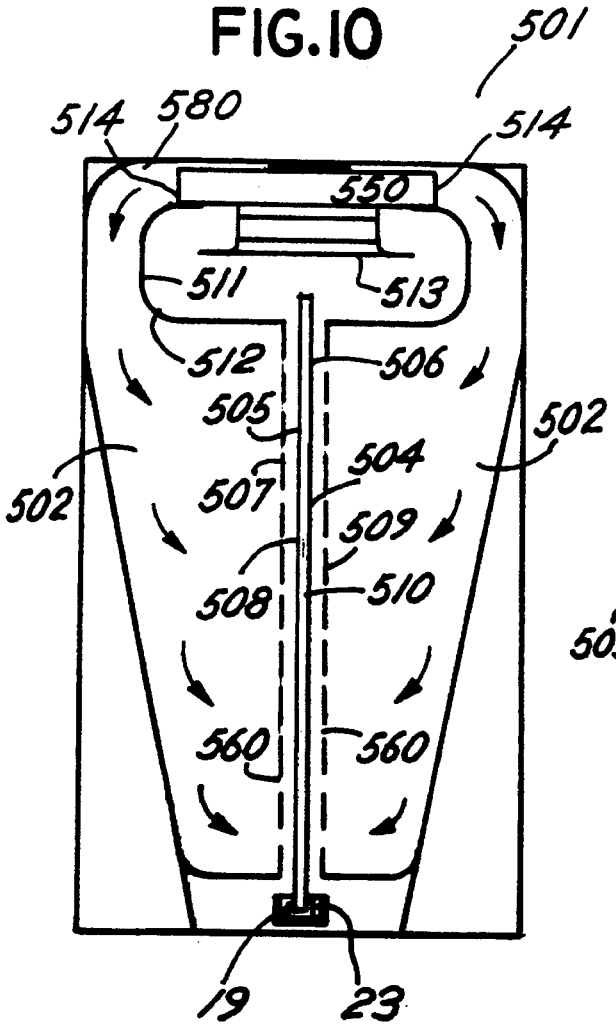
FIGS. 10 and 11 are side and front views of another preferred embodiment of an apparatus for use in the present invention having a single fan at one side of the apparatus.
Figure 11:
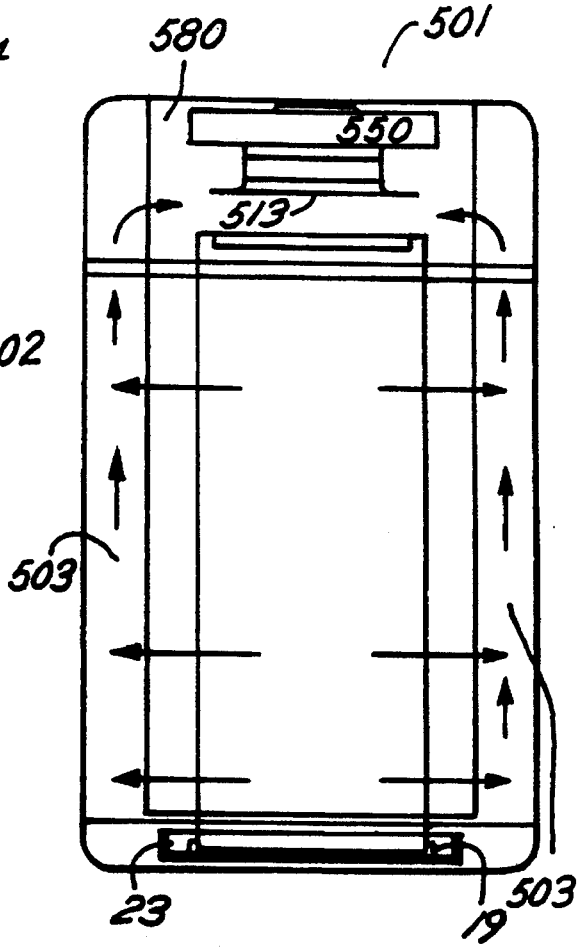

FIGS. 10 and 11 show another embodiment of the apparatus for use in the present invention having an air impingement gel drying apparatus 501 having an enclosed chamber 580. Enclosed chamber 580 has front and back chambers 502 and side chambers 503. Air flow is shown with arrows. Apparatus 501 has an electrophoresis gel/glass plate combination 504 and a blower fan 550. Electrophoresis gel/glass plate combination 504 is comprised of a gel 505 (the thickness of which has been enlarged in FIG. 10 so that it can be identified) that is adhered to a glass plate 506. Blower fan 550 is positioned above electrophoresis gel/glass plate combination 504.

Further, apparatus 501 has a front impingement plate 507 that faces front 508 of gel 504, and a back impingement plate 509 that faces back 510 of glass plate 506. Both front impingement plate 507 and back impingement plate 509 have a plurality of impingement holes 560 (that are not shown in FIG. 11 but are the same as the impingement holes 213 shown in FIG. 5). Apparatus 501 also has a diverter plate 511 that is positioned above electrophoresis gel/glass plate combination 504.

Air is circulated by blower fan 550 around the outside surface 512 of diverter plate 511 and around impingement plates 507 and 509. The circulating air enters through impingement holes and then, as the air moves to side chambers 503, the air carries moisture away from gel 505. The air then flows through side chambers 503 and to intake 513 of the blower fan 550. High moisture removal from gel 505 is obtained by the air flowing at high velocity through the impingement holes 560 the impingement plates 507 and 509 at substantially right angles to the gel 505 and glass plate 506. Diverter plate 511 separates the air exiting from exit 514 of blower fan 550 and the air returning to the blower fan 550 at intake 513. In this embodiment, a heated coil can be positioned just below fan 550 in order to heat air before it is blown by fan 550 to the gel/glass plate combination 504.

As in the embodiment shown in FIG. 1 and 2, the gel/glass plate combination can sit on a support 19 and be held in a substantially vertical position by clips (that are not shown but are the same as clips 20 shown in FIG. 1 and 2). Again, the support 19 can be the bottom of a lower buffer reservoir 23 that does not contain a lower buffer solution.

The foregoing embodiments of the present invention demonstrate that there are alternative positions of the blower fan, sometimes referred to herein as a blower or fan, in relation to the rest of the apparatus. Those skilled in the art will recognize that the position of the blower fan is a, design choice that may involve safety and balancing considerations. However, considering all factors, the embodiment shown in FIG. 1 and 2 is believed to be the preferred construction.

Figure 12:
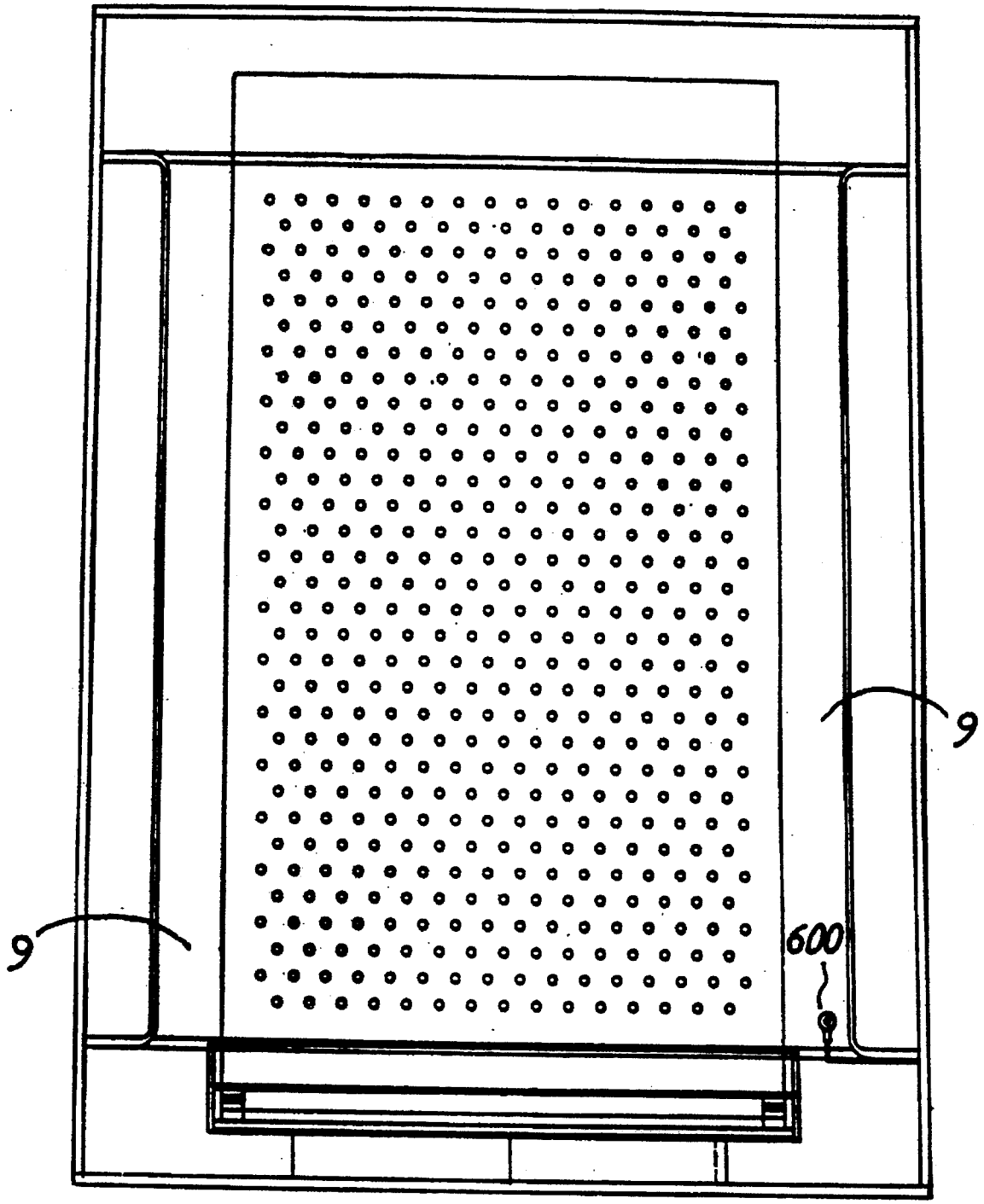
FIG. 12 shows the location of the temperature probe 600 on the back impingement plate 9 in the present invention.

FIG. 12 shows the location of the temperature probe 600 on the back impingement plate 9 in the present invention. Temperature probe 600 can be placed on either the back impingement plates or the front impingement plates of the foregoing embodiments. In the preferred embodiment, temperature probe 600 is placed near the bottom of and on the back impingement plate 9 of FIG. 1 and 2.

Figure 13:
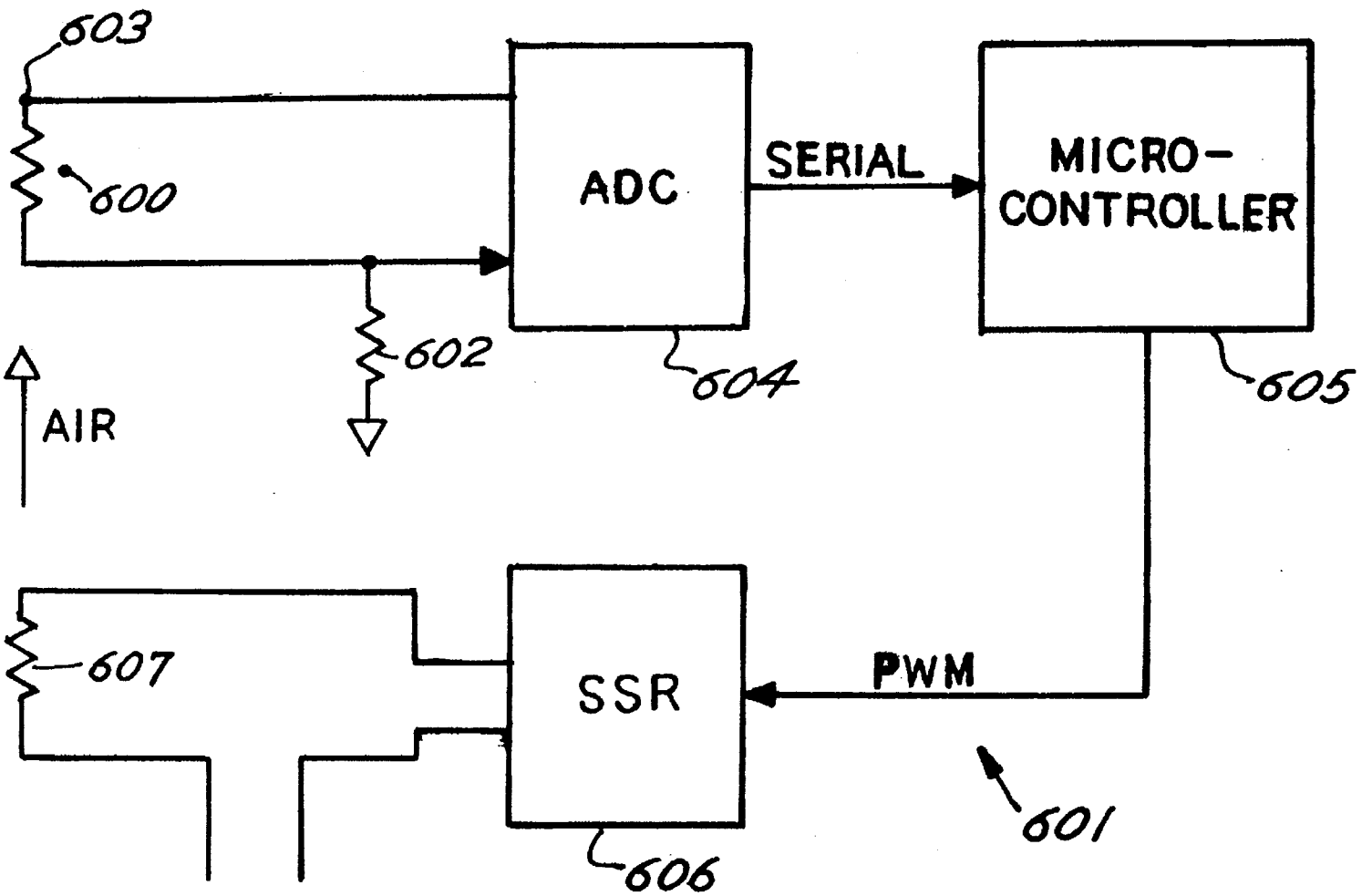
FIG. 13 is a schematic view of the temperature control system 601 of the present invention.

FIG. 13 is a schematic view of the temperature control system 601 of the present invention. Temperature control system 601 is a closed loop temperature control system. The Temperature probe 600 is a precision thermistor which is accurate within 0.2° C. from 0° to 70° C. Temperature probe 600 in combination with a fixed resistor 602 results in a voltage divider which converts the resistance changes to voltage variations. Temperature probe 600 is in the high side and the fixed resistor 602 is in the low side of the voltage divider. This makes the temperature to voltage curve more linear than the temperature probe 600 itself.

The voltage is then converted to a digital signal by a 12-bit analog-to-digital converter ("ADC") 604. The reference voltage 603 supplies the voltage to the voltage divider. This makes the ADC reading ratio-metric. Changes in the reference voltage 603 will not effect the reading. The error in the reading then consists of the tolerance of the temperature probe 200, the tolerance of the resistor 602, the offset of the ADC 604, and the linear error of the ADC 604.

The micro-controller 605 reads the ADC 604 once every second. It uses a look-up table with about 0.1° C. increments and linear interpolation to calculate the temperature. The temperature reading is subtracted from the preset value. This is the temperature error. The temperature error is fed to the micro-controller 605. The output controls the heater 607 through pulse width modulation "PWM"). The micro-controller 605 uses a real time clock at 61 Hz to control the PWM period of 1 Hz, and the heater 607 that heats the air can be controlled via a solid state relay "SSR") switch 606 in $1/61$ increments.

The heater 607 is powered by the AC line voltage because of the relatively high power level of the 450 W. The heater 607 can be turned on and off by the solid state relay switch 606. The solid state relay switch 606 only turns on and off at the AC voltage's zero crossing. The frequency of the PWM was selected to be 1 Hz. During the 1 second cycle there will be 120 (100 with 50 Hz) zero crossings of the AC line voltage. The heater 607 can then be controlled from full off to full on in $1/120$(or $1/100$) increments for finer resolution than the real time clock. The resolution will therefore be $1/61$, which is fine enough for the specified control. In the preferred embodiment, the temperature of the heated air is maintained in a range of about 35° C. to 45° C. during the drying of the gel within a tolerance of about plus or minus 1° C. The temperature of the heated air can be increased or decreased as desired.

The foregoing detailed description of the invention has been made in general terms and with respect to several preferred embodiments. Many of the preferred apparatuses and methods stated herein may be varied by persons skilled in the art without departing from the spirit and scope of the present invention as set forth in the following claims and equivalents.

What is claimed is:

1. A method for drying electrophoresis gel on a glass plate after electrophoresis separation comprising:

(a) providing an enclosed chamber which has within it a front impingement plate and a back impingement plate, each with a plurality of openings, a means for driving a moisture removing gas through the openings to create turbulent air flow, and a means for mounting a gel and glass plate in the chamber and parallel to and between the impingement plates so that gas passing through the openings circulates and impinges on the electrophoresis gel and the glass plate, (b) placing a gel and glass plate in the chamber on the means for mounting the gel and glass plate, and (c) driving moisture removing gas through the openings in the impingement plates to uniformly dry the electrophoresis gel.

2. The method of claim 1, including the step of heating the moisture removing gas before driving the moisture removing gas through the openings.

3. The method of claim 2, wherein the temperature of the moisture removing gas is maintained in a range of about 35° C. to 45° C. during the drying of the gel.

4. The method of claim 3, wherein the temperature of the moisture removing gas is maintained within a tolerance range of plus or minus 1° C.

5. A device for drying electrophoresis gel on a glass plate after electrophoresis separation comprising:

(a) an enclosed chamber which has within it a front impingement plate and a back impingement plate, each with a plurality of openings, (b) a means for driving a moisture removing gas through the openings to create turbulent air flow, and (c) a means for mounting a gel and glass plate in the chamber and parallel to and between the impingement plates so that gas passing through the openings uniformly dries the electrophoresis gel.

6. The device of claim 5, including a heater to heat the moisture removing gas.

7. The device of claim 6, wherein the heater maintains the moisture removing gas in a range of about 35° C to 45° C. during the drying of the gel.

8. The device of claim 7, wherein the heater maintains the moisture remonving gas within a tolerance range of plus or minus 1° C.

* * * * *